US006167871B1

(12) United States Patent
Kumagai et al.

(10) Patent No.: US 6,167,871 B1
(45) Date of Patent: Jan. 2, 2001

(54) FUEL CATALYST APPARATUS FOR EXHAUST GAS PURIFICATION

(75) Inventors: Nobuyuki Kumagai, 2-7 Yasaka 2-chome, Ohno-cho, Saeki-gun, Hiroshima-ken; Yoshimi Fujii, 8346-3, Yuu-cho, Kuga-gun, Yamaguchi-ken, both of (JP)

(73) Assignees: Nobuyuki Kumagai, Hiroshima-ken; Yoshimi Fujii, Yamaguchi-ken, both of (JP)

( * ) Notice: Under 35 U.S.C. 154(b), the term of this patent shall be extended for 0 days.

(21) Appl. No.: 09/190,188

(22) Filed: Nov. 12, 1998

(51) Int. Cl.[7] ..... F02M 33/00
(52) U.S. Cl. ..... 123/538
(58) Field of Search ..... 123/538, 536, 123/537

(56) References Cited

U.S. PATENT DOCUMENTS 4,469,076 * 9/1984 Wolff ..... 123/538
5,044,346 * 9/1991 Tada et al. ..... 123/538
5,069,190 * 12/1991 Richards ..... 123/538
5,074,273 * 12/1991 Brown ..... 123/538
5,092,303 * 3/1992 Brown ..... 123/538

FOREIGN PATENT DOCUMENTS 7806 1/1995 (JP) .
742907 2/1995 (JP) .

* cited by examiner

*Primary Examiner*—Marguerite McMahon
(74) *Attorney, Agent, or Firm*—Birch, Stewart, Kolasch & Birch, LLP

(57) ABSTRACT

The present invention relates to a catalyst apparatus for exhaust gas purification which decreases toxic substances included in the exhaust gas of internal combustion engines, by interposing a catalyst in a fuel pipe connecting a fuel tank and the internal combustion engine and charging the fuel with negative electric charges thereby improving the combustion efficiency, to be used in the field of exhaust gas purification for internal combustion engines of automobiles, watercraft and aircraft. The catalyst device 20 or 30 is installed for giving negative electric charges to a liquid petroleum fuel 18 which is sent through a fuel pipe 12 running from a fuel tank 11 to the internal combustion engine 14.

6 Claims, 2 Drawing Sheets

FUEL CATALYST APPARATUS FOR EXHAUST GAS PURIFICATION

FIELD OF INDUSTRIAL UTILIZATION

The present invention relates to a fuel catalyst apparatus for exhaust gas purification which decreases toxic substances included in the exhaust gas of internal combustion engines, by interposing a catalyst in a fuel pipe connecting a fuel tank and the internal combustion engine and charging the fuel with negative electric charges thereby improving the combustion efficiency, to be used in the field of exhaust gas purification for internal combustion engines of automobiles, watercraft and aircraft.

BACKGROUND OF THE INVENTION

In the automobile industry, a three way catalyst installed in the exhaust pipe of an internal combustion engine is commonly used for post-treatment of toxic substances discharged from the internal combustion engine. This process is employed in lean-burn engines of higher combustion efficiency, direct injection diesel engines and direct injection gasoline engines.

PROBLEM THE INVENTION AIMS TO SOLVE

It has been a problem in this industry to find a solution to eliminate toxic substances from the exhaust gas of an internal combustion engine. As it is impossible to eliminate 100% of the toxic substances with the prior art technologies, the toxic substances in the exhaust gas can be decreased further by adding an apparatus of the invention to the prior art technologies as required. The present invention is intended to provide a new type of catalyst for pre-burning treatment and make contributions to the cause of environmental conservation.

MEANS FOR SOLVING THE PROBLEM

It is an object of the exhaust gas purifying apparatus of the invention to provide a fuel catalyst apparatus for exhaust gas purification wherein a catalyst device is installed to provide negative electric charges to liquid petroleum fuel which is sent through a fuel pipe running from a fuel tank to an internal combustion engine.

This makes it possible to improve the combustion efficiency of the fuel through catalyst treatment before burning in the internal combustion engine and decreases the toxic substances discharged from the internal combustion engine, thereby contributing to the cause of environmental conservation and savings in fuel consumption.

Another object of the invention is to provide a fuel catalyst apparatus for exhaust gas purification wherein an electrode is installed in a fuel pipe and a negative electric charge output terminal of a static electricity generator installed outside the fuel pipe is connected to the electrode with a lead wire, as a catalyst device.

According to the invention, a negative electric charge is generated in the fuel pipe from the negative electric charge output terminal of the static electricity generator, thereby charging the fuel with negative electric charges and achieving the object.

An additional object of the invention is to provide a fuel catalyst apparatus for exhaust gas purification wherein the catalyst device is a cylinder containing a substance that easily charges positively such as tridymite, nylon or silk and is disposed in the fuel pipe, while liquid fuel passing through the fuel pipe is brought into contact with the substance.

This makes it possible to charge the fuel negatively via the positively charged substance, thereby achieving the object.

Furthermore another object of the invention is to provide a fuel catalyst apparatus for exhaust gas purification wherein the cylinder is made of nylon which easily charges negatively while the cylinder and a portion of the vehicle body equipped with the internal combustion engine such as a shroud disposed besides a fan that easily charges positively are electrically connected, thereby supplying negative electric charges to the cylinder.

This makes it possible to supply negative electric charges intermittently and effectively to the cylinder and charge the fuel negatively, thereby achieving the object.

The above and other objects and effects of the invention will be made apparent from the description that follows.

DETAILED DESCRIPTION OF THE INVENTION

Figure 1:
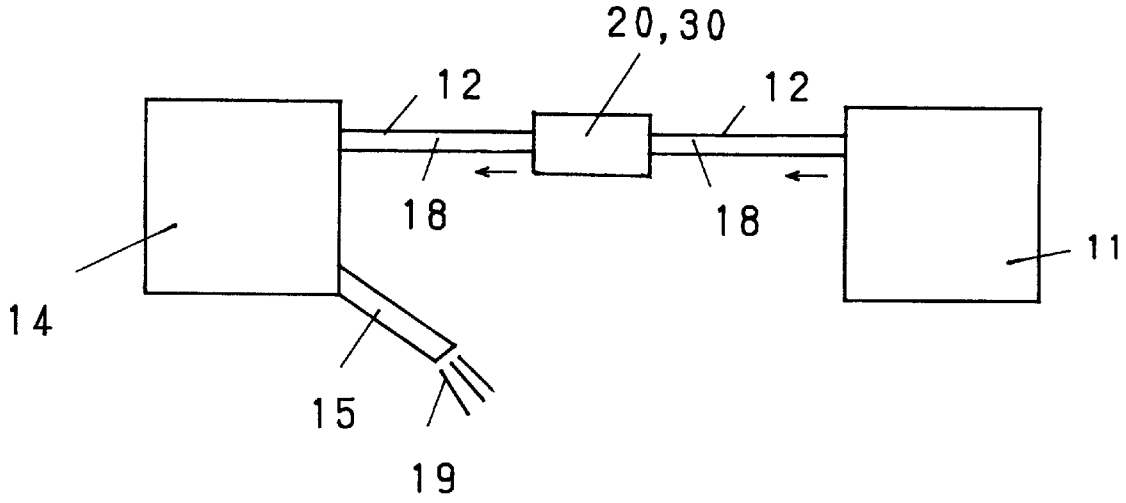
FIG. 1 is a total layout diagram of the invention.

The invention will now be described in detail below, in conjunction with the preferred embodiments of the invention. A fuel catalyst apparatus for exhaust gas purification of the invention has a catalyst device which gives negative electric charges to liquid petroleum fuel which is sent through a fuel pipe running from a fuel tank to an internal combustion engine.

The fuel catalyst of the invention may be constituted by two different means. One is an electrical means for charging a fuel 18 negatively by giving negative electric charges of a static electricity generator 21 thereto, and the other is a means for generating static electricity by bringing a substance 32 which easily charges positively into contact with the fuel 18, thereby charging the fuel 18 negatively. Both of these means are preferably installed at a point immediately before the fuel 18 enters the internal combustion engine 14.

All substances on earth, for example, water, air and iron, are made up of atoms. An atom consists of a nucleus having positive electricity and electrons having negative electricity, the amounts of positive electricity and negative electricity being the same and attracted to each other, thereby keeping the atom stable. However, a metal includes free electrons which are detached from the atoms and are free to move in the metal. When the free electrons depart from atoms, oxides which cause rusting are likely to combine with the atoms and cause the metal to rust. When the void left by the free electrons is filled with electrons supplied from the outside, the metal atoms are stabilized and become less likely to combine with oxides, thus it is made possible to prevent the metal from rusting. Static electricity generators which achieve this process electrically have been commercialized.

When $SiO_2$ (quartz) is heated and exposed to light, tridymite is produced. Among natural rocks, there are some classes of metamorphic rock which include quartz and can be used as a material to make a catalyst, such as phyllite, crystalline schist, gneiss, hornfels and quartzite which emerges to the ground surface and is exposed to sunlight. In order to produce tridymite artificially, such rock is heated to a temperature of 867° C. or higher, thereby transforming the rock to tridymite. Transformation to tridymite by heating a from temperature of 867° C. to 1470° C. is preferable. Transformation to tridymite can be achieved faster at a temperature near 1470° C. When exposed to sunlight over a long period of time (at least 30 minutes), tridymite is easily charged.

FIG. 1 shows an example of the invention. In FIG. 1, a fuel pipe 12 is connected to a fuel tank 11, and a fuel catalyst 20 based on a static electricity generator or a fuel catalyst 30 made of a substance which easily charges positively is disposed between the fuel pipe 12 and the fuel tank 11, thereby improving the combustion efficiency of the fuel 18 in the internal combustion engine 14. Numeral 15 denotes an exhaust pipe and numeral 19 denotes exhaust gas.

Figure 2:
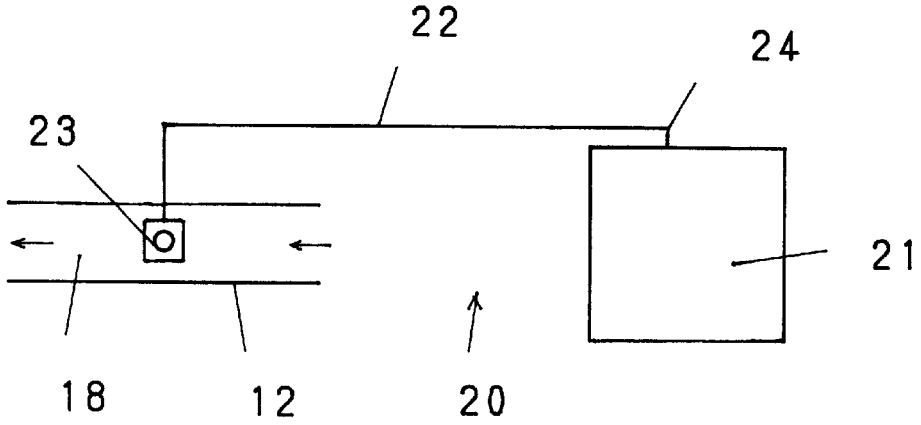
FIG. 2 is a front cross sectional view of a key portion of the invention where a static electricity generator is used as catalyst.
Figure 3:
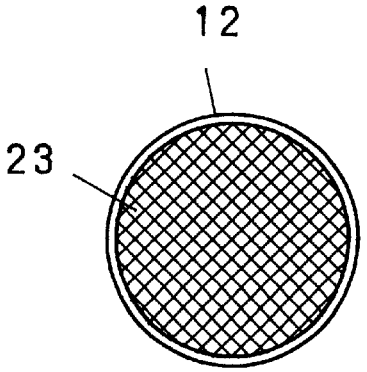
FIG. 3 is a front cross sectional view of a key portion according to another embodiment of the invention.

FIG. 2 shows electrical means which employ the substance that is easily charged as described above. In FIG. 2, a terminal 24 of a static electricity generator 21 and an electrode 23 installed in the fuel pipe 12 are connected by a lead wire 22, thereby charging the fuel 18 flowing therein negatively. The electrode 23 may also be made in a net configuration as shown in FIG. 3, thereby improving the efficiency of charging the fuel 18.

Figure 4:
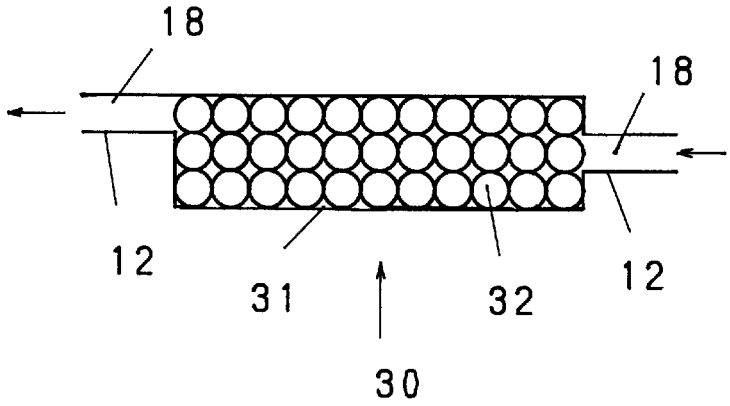
FIG. 4 is a front cross sectional view of a key portion of the invention where a substance which easily charges positively is used as the catalyst.

FIG. 4 shows examples of the charged substances described above. A cylinder 31 is disposed between the fuel pipe 12, with the cylinder 31 being filled with a substance 32 of spherical shape which easily charges positively, for example tridymite described above, nylon and silk.

It is preferable to connect the output end of the fuel pipe 12 at a position eccentric upward of the cylinder 31, as shown in FIG. 4, as a bubble region is not produced and deterioration in performance can be prevented with this configuration.

Figure 5:
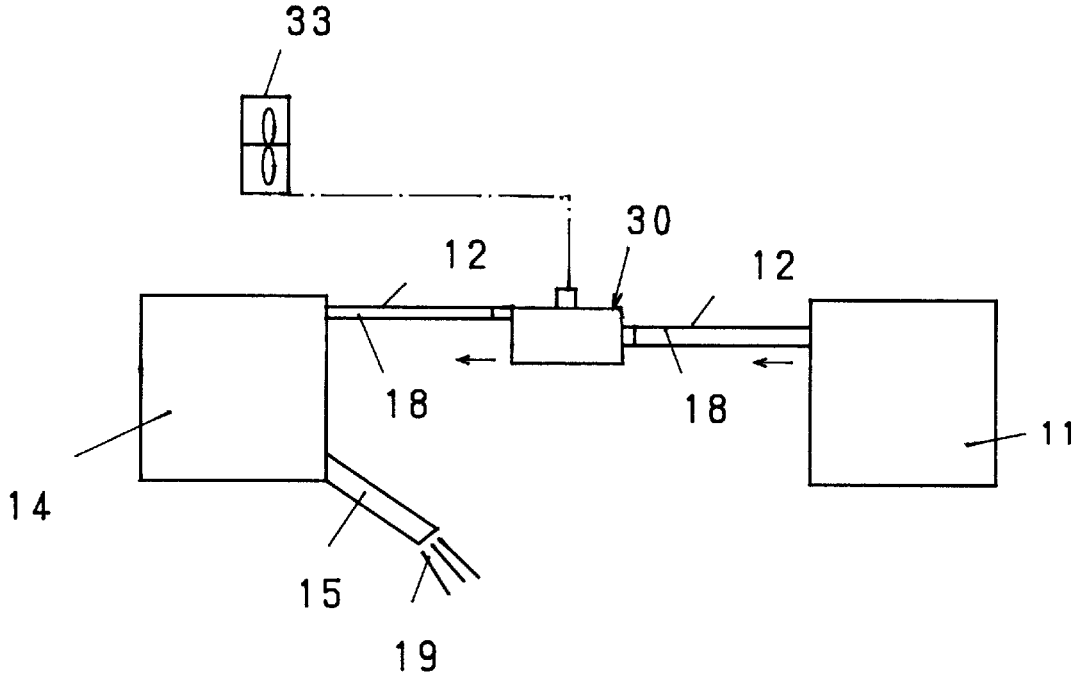
FIG. 5 is a total layout diagram according to another embodiment of the invention.

FIG. 5 shows other examples of the charged substances according to the invention, where the cylinder 31 is made of nylon which easily charges positively, while the cylinder 31 is connected to a portion, in the vehicle body equipped with the internal combustion engine such as a shroud disposed beside a fan 33, which easily charges negatively.

PREFERRED EMBODIMENTS

Embodiment 1

The electrode 23 was put into the fuel pipe 12 of a gasoline engine car having engine displacement of 660 cc, and concentrations of CO and HC in 1 gram of exhaust gas were measured while supplying negative electric charges and positive electric charges from the static electricity generator 21 to the electrode 23. The results are as follows.

| 660 cc gasoline engine | CO (%) | HC (ppm) |
|---|---|---|
| Normal | 1.0 | 180 |
| Positive terminal | 1.4 | 280 |
| Negative terminal | 0.01 | 14 |

The measurements were made by using a CO—HC analyzer EIR 2105 (manufactured by Yagiu Seisakusho Co., Ltd.), in a procedure equivalent to that of an official vehicle inspection. These results show that the function of fuel catalyst can be achieved with negative charges. The results are as follows.

Embodiment 2

Nylon balls 32, 8 mm in diameter, were put in the cylinder 31 measuring 30 mm in diameter and 200 mm in length and connected to the fuel pipe 12, where an experiment similar to the first embodiment was conducted. The results are as follows.

| 660 cc gasoline engine | CO (%) | HC (ppm) |
|---|---|---|
| Normal | 1.0 | 180 |
| With the apparatus(nylon) | 0.001 | 6 |

Embodiment 3

Tridymite (quartz SiO2) 32 exposed to sunlight was put in the same cylinder 31 measuring 30 mm in diameter and 200 mm in length as that described above and connected to the fuel pipe 12, where an experiment similar to the first embodiment was conducted. The results are as follows.

| 660 cc gasoline engine | CO (%) | HC (ppm) |
|---|---|---|
| Normal | 1.0 | 180 |
| With the apparatus(nylon) | 0.001 | 6 |

Embodiment 4

An experiment was conducted by electrically connecting a resin (a position that easily charges positively) used in the vehicle body disposed beside the fan and the fuel pipe 12 (fuel element, engine or the like making contact with the fuel), thus giving negative charges to the fuel.

| 660 cc gasoline engine | CO (%) | HC (ppm) |
|---|---|---|
| Normal | 1.0 | 180 |
| Apparatus of Embodiment 4 | 0.02 | 10 |

In a case in which the cylinder 31 made of nylon is filled with nylon balls 32 similar to the second embodiment and was connected to the portion beside the fan 33 as shown in FIG. 5, similar results to the second embodiment were obtained.

EFFECTS OF THE INVENTION

According to the invention, as described above, combustion efficiency is improved by using the internal combustion engine as a catalyst for liquid petroleum fuel and, as a consequence, toxic substances (CO, HC, soot) discharged from the internal combustion engine are decreased, thus making contributions to environmental conservation and savings in fuel consumption. The invention's main applications are for automobiles, watercraft, aircraft and electric power plants.

This invention is not restricted to the embodiments, and any various variations may be practiced without departing the spirit thereof.

What is claimed is:

1. A fuel catalyst apparatus for exhaust gas purification which purifies the exhaust gas from an internal combustion engine, wherein a catalyst device is installed for giving negative electric charges to a liquid petroleum fuel which is sent through a fuel pipe running from a fuel tank to the internal combustion engine, wherein the catalyst device is made in such a configuration as a cylinder, filled with a substance which easily charges positively, and is disposed in the fuel pipe, and the liquid fuel flowing through the fuel pipe is brought into contact with the substance, and wherein the substance which easily charges positively is tyidymite, nylon or silk.

2. A fuel catalyst apparatus for exhaust gas purification as claimed in claim 1 where an output end of the cylinder is elevated relative to an input end of the cylinder.

3. A fuel catalyst apparatus for exhaust gas purification as claimed in claim 1 wherein the cylinder is made of nylon which is easily charged positively, and a portion of a vehicle body which easily charges positively is electrically connected to the cylinder, thereby supplying negative electric charges to the cylinder.

4. A fuel catalyst apparatus for exhaust gas purification as claimed in claim 6 wherein the cylinder is made of nylon which easily charges positively, and a portion of the vehicle body which easily charges positively is electrically connected to the cylinder, thereby supplying negative electric charges to the cylinder.

5. The apparatus according to claim 3, wherein the portion of the vehicle body which easily charges positively is a fan shroud disposed beside a fan.

6. The apparatus according to claim 4, wherein the portion of the vehicle body which easily charges positively is a fan shroud disposed beside a fan.

* * * * *